US011331780B2

(12) United States Patent
Zhao et al.

(10) Patent No.: US 11,331,780 B2
(45) Date of Patent: May 17, 2022

(54) NAIL GUN

(71) Applicant: NANJING CHERVON INDUSTRY CO., LTD., Nanjing (CN)

(72) Inventors: Xiaozhe Zhao, Nanjing (CN); Xiangxiang Liu, Nanjing (CN)

(73) Assignee: NANJING CHERVON INDUSTRY CO., LTD., Nanjing (CN)

( * ) Notice: Subject to any disclaimer, the term of this patent is extended or adjusted under 35 U.S.C. 154(b) by 337 days.

(21) Appl. No.: 16/427,304

(22) Filed: May 30, 2019

(65) Prior Publication Data

US 2019/0283225 A1 Sep. 19, 2019

Related U.S. Application Data

(63) Continuation of application No. PCT/CN2017/115329, filed on Dec. 8, 2017.

(30) Foreign Application Priority Data

Dec. 9, 2016 (CN) ..... 201611131467.5
Mar. 6, 2017 (CN) ..... 201720212710.X

(51) Int. Cl.
*B25C 1/04* (2006.01)
*B25C 1/06* (2006.01)

(52) U.S. Cl.
CPC ..... *B25C 1/043* (2013.01); *B25C 1/04* (2013.01); *B25C 1/047* (2013.01); *B25C 1/06* (2013.01)

(58) Field of Classification Search
CPC ..... B25C 1/04; B25C 1/041; B25C 1/043; B25C 1/047; B25C 1/06
(Continued)

(56) References Cited

U.S. PATENT DOCUMENTS 10,471,579 B2 * 11/2019 Zhang ..... B25C 1/047
2007/0175945 A1 8/2007 Chen et al.
(Continued)

FOREIGN PATENT DOCUMENTS

CN 101224570 A 7/2008
CN 204736190 U * 11/2015 ..... B25C 1/047
(Continued)

OTHER PUBLICATIONS

Machine Translation CN-204736190-U, Zhang Huading (Year: 2021).*
(Continued)

*Primary Examiner* — Anna K Kinsaul
*Assistant Examiner* — Veronica Martin
(74) *Attorney, Agent, or Firm* — McCarter & English, LLP

(57) ABSTRACT

Provided is a nail gun, including: a housing, a firing pin, a prime mover, a first cylinder, a first piston, a second cylinder, a second piston, and a locking member. A first chamber is defined in the first cylinder, the first piston is disposed in the first chamber and is fixedly connected to the firing pin, the second cylinder is formed with the second chamber that is in communication with the first chamber. The second piston is disposed in the second chamber and operative to be driven by the prime mover to perform a reciprocating motion between a first position and the second position along a first straight line. The locking member is configured for locking or releasing the first piston in the first chamber, and the first piston is formed or connected with: a locking portion configured for engaging with the locking member. When the second piston is at the first position, the locking member is operative to be engaged with the locking portion to lock the first piston within the first chamber, and when the second piston is at the second position, the prime mover is operative to drive the locking member out of engagement with the
(Continued)

locking portion to release the first piston within the first chamber.

18 Claims, 16 Drawing Sheets

(58) Field of Classification Search
USPC ..... 227/130
See application file for complete search history.

(56) References Cited

U.S. PATENT DOCUMENTS

| | | | | |
|---|---|---|---|---|
| 2010/0213235 | A1* | 8/2010 | Pedicini | B25C 1/047 227/130 |
| 2012/0187178 | A1 | 7/2012 | Campbell | |
| 2015/0129630 | A1* | 5/2015 | Matsuno | B25C 1/06 227/130 |

FOREIGN PATENT DOCUMENTS

| | | | |
|---|---|---|---|
| CN | 204736190 | U | 11/2015 |
| CN | 105818099 | A | 8/2016 |
| CN | 205685265 | U | 11/2016 |
| CN | 206614481 | U | 11/2017 |
| WO | 2012/061295 | A2 | 5/2012 |
| WO | 2018/103752 | A1 | 6/2018 |

OTHER PUBLICATIONS

International Search Report dated Mar. 15, 2018, issued in connection with International Application No. PCT/CN2017/115329, with English translation thereof (4 pages).
Chinese Office Action dated Jan. 8, 2021, issued in connection with Chinese Patent Application No. 201780003605.8, and English translation thereof (13 pages).

* cited by examiner

NAIL GUN

CROSS-REFERENCE TO RELATED APPLICATIONS

This application is a continuation application of International Application number PCT/CN2017/115329, filed Dec. 8, 2017, which claims the priority of Chinese Patent Application number 201611131467.5 filed Dec. 9, 2016, and of Chinese Patent Application number 201720212710.X filed Mar. 6, 2017, the disclosures of all of which are incorporated herein by reference in their entireties.

BACKGROUND

Technical Field

The present disclosure relates to power tools, for example, to a nail gun for impacting a fastener.

Background

A nail gun is a power tool operative to produce an impact to impact a nail with a firing pin.

The nail gun generally includes a housing, a cylinder, a piston, a firing pin, a prime mover, and an impact mechanism. The piston is disposed in the cylinder. The firing pin is connected to the piston. The prime mover moves the piston within the cylinder by driving the impact mechanism. In order to lock the firing pin in the nail gun, a groove or the like can be defined. This results in unsatisfactory reliability and can easily cause lock failure of the firing pin.

SUMMARY

The present disclosure provides a reliable nail gun.

The nail gun may include a housing, a firing pin, a prime mover, a first cylinder, a first piston, a second cylinder, a second piston, and a locking member. The firing pin includes an impact portion for impacting the fastener, the prime mover is disposed in the housing, the first cylinder is formed with the first chamber, the first piston is disposed in the first chamber and is fixedly connected to the firing pin, the second cylinder is formed with the second chamber that is in communication with the first chamber, the second piston, disposed in the second chamber and operative to be driven by the prime mover to perform a reciprocating motion between a first position and the second position along a first straight line, the locking member is configured for locking or releasing the movement of the first piston in the first chamber, and the entirety consisting of the first piston and the firing pin is formed or connected with: a locking portion configured for engaging with the locking member. When the second piston is at the first position, the locking member is operative to be engaged with the locking portion to lock the movement of the entirety, consisting of the first piston and the firing pin, relative to the first cylinder, and when the second piston is at the second position, the prime mover is operative to drive the locking member out of engagement with the locking portion to release the movement of the first piston within the first chamber.

In some embodiments, the locking member may be disposed on a side of the first piston facing away from the impact portion.

In some embodiments, the prime mover may be an electric motor.

In some embodiments, the nail gun may further include a biasing component, producing a bias force that moves the locking piece toward a position that locks the first piston. In some embodiments, the nail gun may further include: a driving member, operative to be driven by the prime mover to perform a reciprocating motion along a direction parallel to the first straight line. The driving member is formed or connected with the driving portion. When the second piston is at the second position, the driving member moves in a direction parallel to the first straight line, and the driving portion is operative to drive the locking member out of engagement with the locking portion.

In some embodiments, the first piston may be fixedly connected to a first connecting member, which is formed with a locking portion. The locking portion may be a groove defined in the first connecting member. The locking member may be a locking pin that is operative to be at least partially embedded in the groove, the biasing component is operative to press the locking pin to move toward being embedded into the groove, and the driving portion is a slope that is operative to drive the locking pin to move in a direction away from the groove.

Alternatively, in some embodiments, the first piston may be fixedly connected to a first connecting member which is formed with a locking portion. The locking member includes a first clamping portion and a second clamping portion that are rotatably connected at one end; the biasing component is operative to press the first clamping portion and/or the second clamping portion so that they both rotate toward each other to clamp the first connecting member. The driving portion is a slope that is operative to drive the first clamping portion and/or the second clamping portion so that they both rotate away from each other to release the first connecting member.

In some embodiments, the first connecting member and the firing pin are respectively disposed on both sides of the first piston.

In some embodiments, the prime mover further includes: a shaft operative to rotate about a first axis. The nail gun may further include: a first connecting rod, a second connecting rod, and a first shaft. The first connecting rod is rotatably connected with the shaft, one end of the second connecting rod is rotatably connected with the first connecting rod, the other end is rotatably connected with the second piston, and the first shaft, configured to be a rotating shaft by which the first connecting rod and the second connecting rod are rotatably connected.

In some embodiments, the nail gun may further include: a third connecting rod and a toggle member. The third connecting rod is rotatably connected to the first connecting rod through the first rotating shaft, and the toggle member is rotatably connected to the third connecting rod. The toggle member includes a toggle portion that when rotating is at least operative to drive the driving member to move toward a position where the driving portion contacts the locking member.

Alternatively, in some embodiments, the entirety consisting of the fire pin and the first piston further includes: a protruding portion configured for forming the locking portion, and located at a side of the first piston away from the impact portion. The locking portion is a groove formed on the protruding portion. The nail gun may further includes: a driving member, configured for driving the locking member to be embedded into the groove to lock the movement of the entirety consisting of the first piston and the fire pin relative to the first air cylinder.

In some embodiments, the driving member may be formed with: a first locking surface and a first release surface. The first locking surface is configured to drive the locking member into the groove when contacting the locking member. The first release surface is configured to allow the locking member to disengage from the groove when contacting the locking member.

In some embodiments, the groove may be an annular groove with a centerline parallel to the first straight line. The locking member may be a locking pin that extends in a direction perpendicular to the first straight line. The two ends of the locking pin may be respectively formed with: a first spherical surface for engaging with the groove and a second spherical surface for engaging with the driving member. In an orientation perpendicular to the first straight line, the first release surface is recessed in a direction away from the locking pin relative to the first locking surface.

Alternatively, in some embodiments, the groove may be an annular groove with a centerline parallel to the first straight line. The locking member is a steel ball operative to move in an orientation perpendicular to the first straight line to be embedded into the groove. In the orientation perpendicular to the first straight line, the first release surface is recessed in a direction away from the locking pin relative to the first locking surface.

In some embodiments, the nail gun may further include: a biasing component, operative to produce a bias force that moves the driving member toward a position where the first locking surface contacts the locking member.

In some embodiments, the prime mover further includes: a shaft operative to rotate about a first axis. The nail gun may further include: a first connecting rod, a second connecting rod, and a first shaft. The first connecting rod is rotatably connected with the shaft, one end of the second connecting rod is rotatably connected with the first connecting rod, the other end is rotatably connected with the second piston, and the first shaft, configured to be a rotating shaft by which the first connecting rod and the second connecting rod are rotatably connected.

In some embodiments, the nail gun may further include: a third connecting rod and a toggle member. The third connecting rod is rotatably connected to the first connecting rod through the first rotating shaft, and the toggle member is rotatably connected to the third connecting rod. The toggle member includes a toggle portion that when rotating is operative to drive the driving member to move toward a position where the first release surface contacts the locking member.

In some embodiments, the firing pin may pass through the first piston along the first straight line; a portion of the firing pin on a side of the first piston away from the impact portion constitutes the protruding portion.

The present disclosure can achieve the purpose of locking the firing pin by locking the first piston, hence high locking reliability of the firing pin.

DETAILED DESCRIPTION

The technical solutions of the present disclosure will be described below in conjunction with the drawings and embodiments. It should be understood that, the specific embodiments set forth below are merely intended to illustrate and not to limit the present disclosure. Additionally, it is to be noted that to facilitate description, only part, not all, of structures related to the present disclosure are illustrated in the accompanying drawings. If not in collision, the following embodiments and features thereof may be combined with each other.

Figure 1:
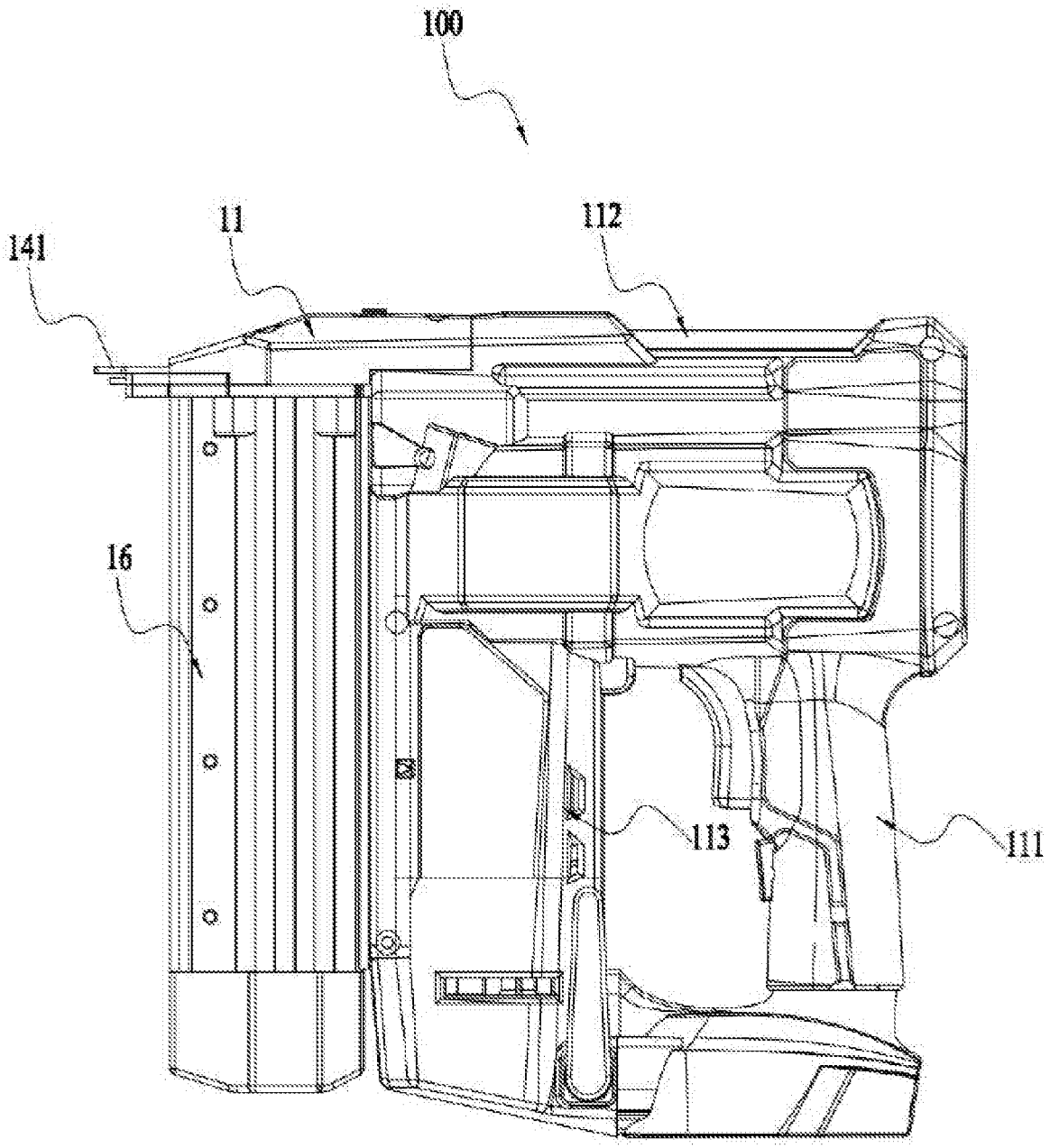
FIG. 1 is a schematic diagram illustrating a nail gun of a first embodiment in accordance with the present disclosure.
Figure 2:
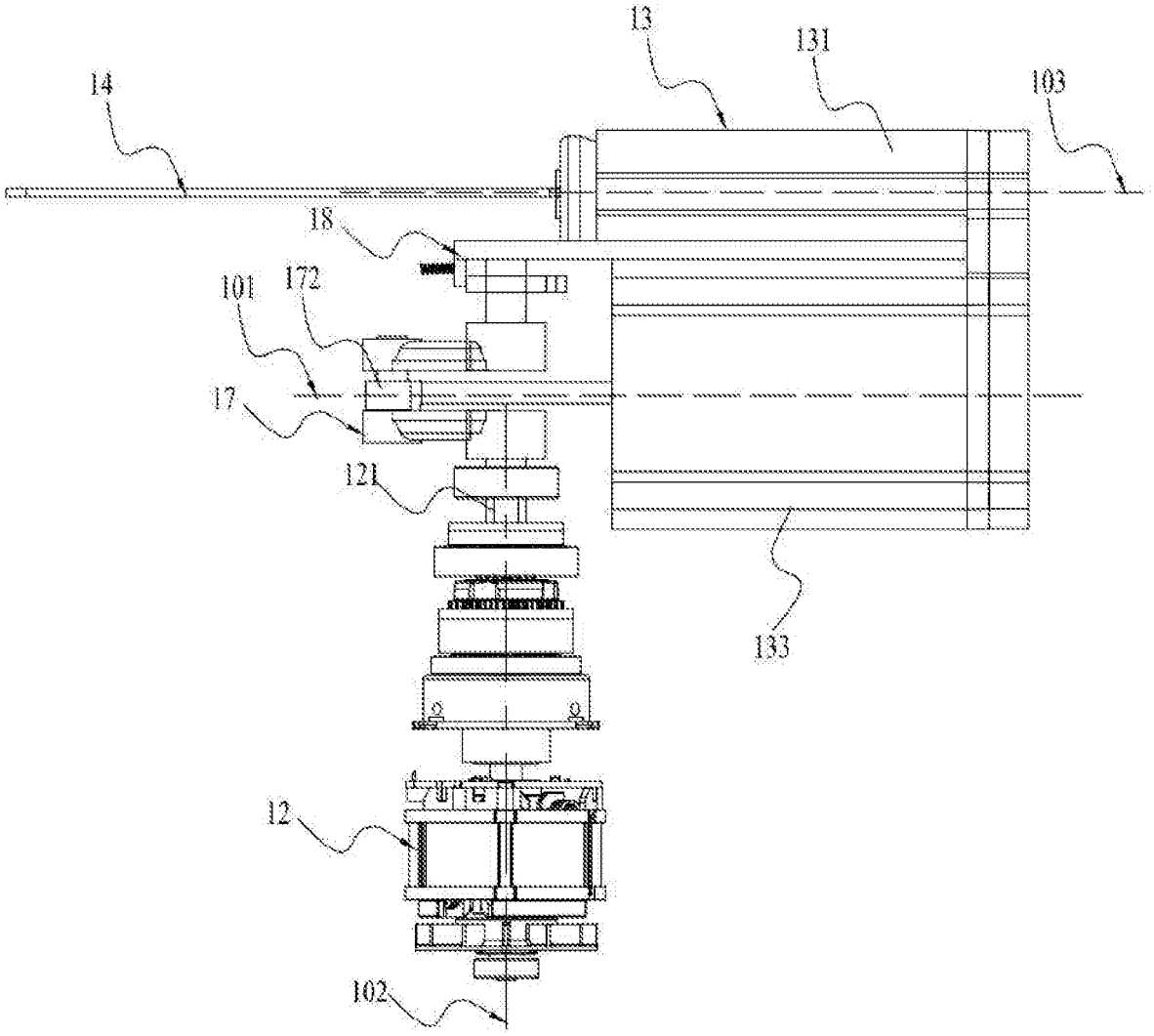
FIG. 2 is a plan view illustrating a partial structure of the nail gun of FIG. 1 in accordance with the present disclosure.
Figure 3:
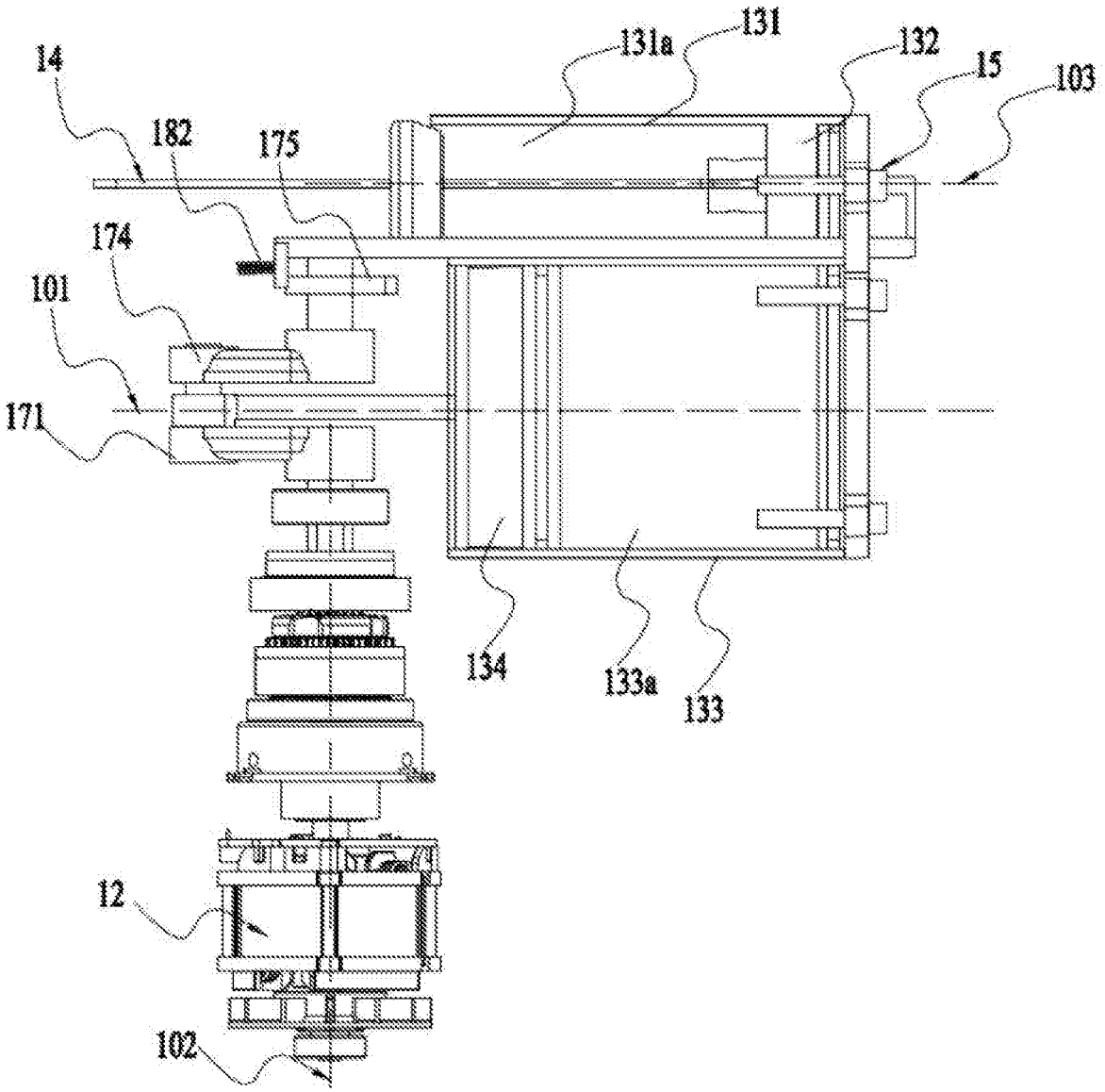
FIG. 3 is a plan view illustrating the structure of FIG. 2 after the first cylinder and the second cylinder are sectioned.
Figure 4:
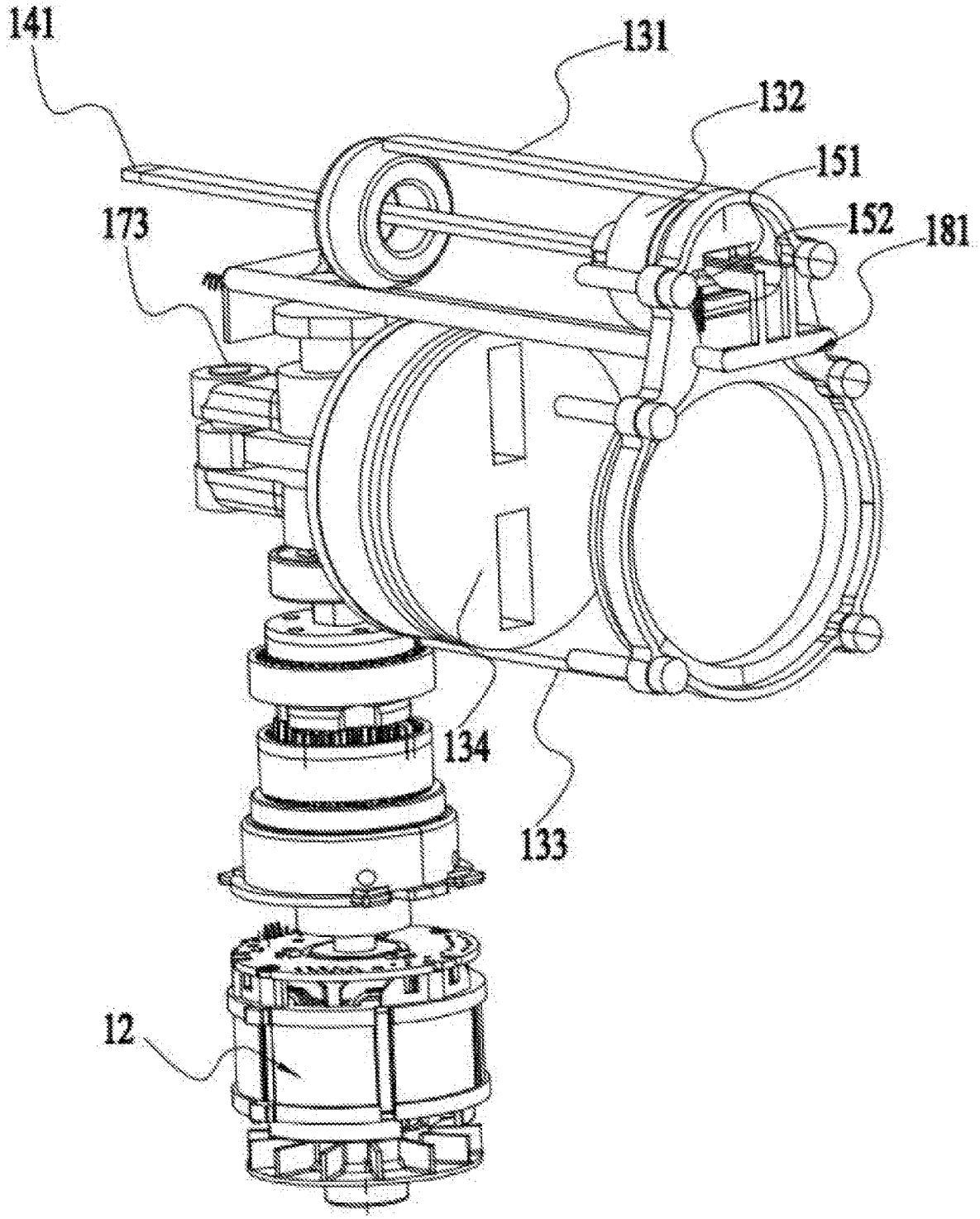
FIG. 4 is a perspective view illustrating a prime mover, an impact mechanism, a firing pin, and a locking mechanism of FIG. 3 in accordance with the present disclosure.
Figure 5:
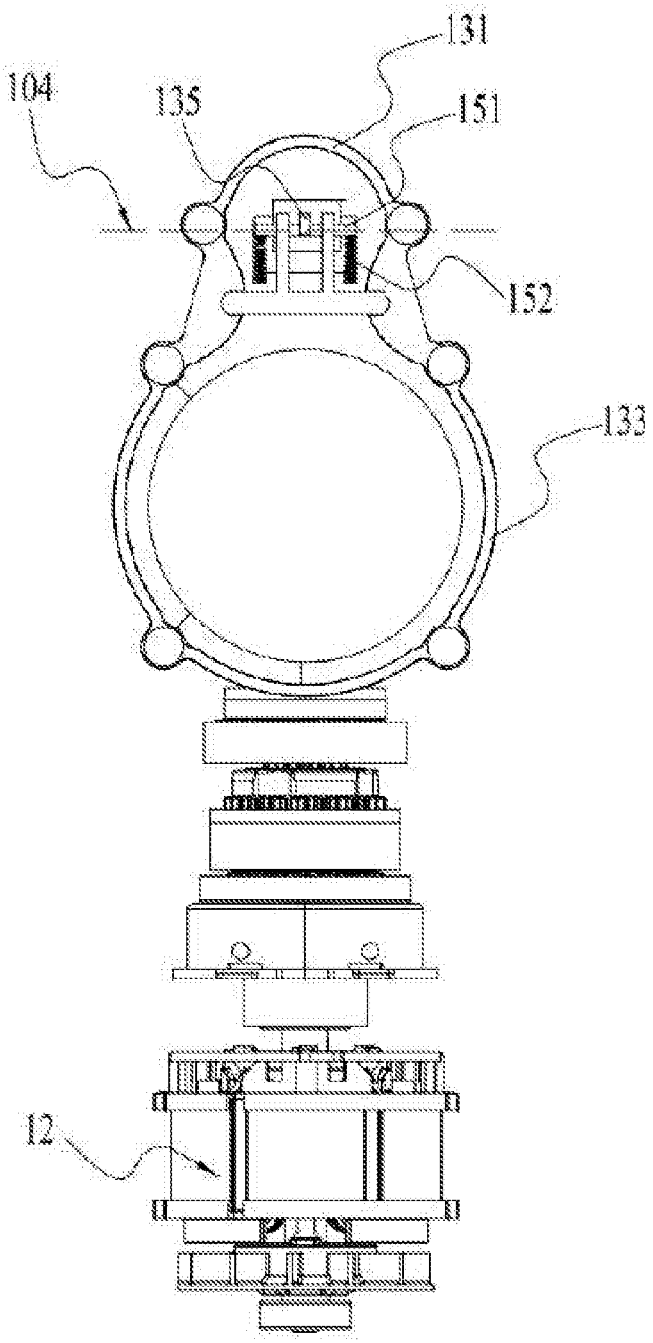
FIG. 5 is a rear view illustrating the prime mover, the impact mechanism, the firing pin, and the locking mechanism of FIG. 3 in the present disclosure.
Figure 6:
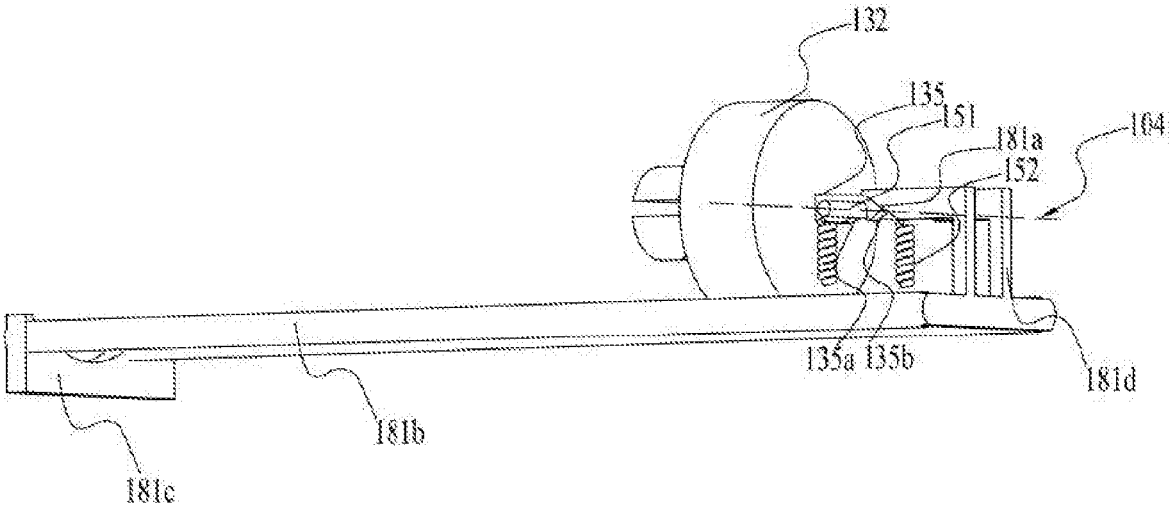
FIG. 6 is a schematic diagram illustrating a drive assembly, a locking assembly, and a first piston of FIG. 5 in accordance with the present disclosure.

FIG. 1 illustrates a nail gun 100 of a first embodiment according to the present disclosure. The nail gun 100 is used for producing an impact force to be applied on a nail, thus driving the nail into a workpiece.

As illustrated in FIGS. 1-9, the nail gun 100 includes a housing 11, a prime mover 12, an impact mechanism 13, a firing pin 14, a locking mechanism 15, and a nail box 16. The impact mechanism 13 may include a first cylinder 131, a first piston 132, a second cylinder 133, and a second piston 134. The firing pin 14 including an impact portion 141 configured for outputting an impact force to the nail to impact a fastener such as a nail, the locking mechanism 15 is configured for locking or releasing the firing pin 14, and the nail box 16 is configured for accommodating the nail.

The housing 11 is formed with an inner space configured for accommodating the prime mover 12 and the impact mechanism 13, and the outer portion of the housing 11 is further connected with a nail box 16 configured for placing nails. The first cylinder 131 defines a first chamber 131*a*, the first piston 132 is disposed in the first chamber 131*a* and is fixedly connected to the firing pin 14, the second cylinder 133 defines a second chamber 133*a*, and the second piston 134 is disposed in the second chamber 133*a*. The first chamber 131*a* and the second chamber 133*a* are in communication with each other. The prime mover 12 is disposed in the housing 11, and the prime mover 12 is operative to drive the second piston 134 to perform a reciprocating motion between a first position and a second position along a first straight line 101 after being started up. The locking mechanism 15 may include a locking member 151 that is disposed on a side of the first piston 132 facing away from the firing pin 14. The first piston 132 is formed with a locking portion 135*a* that is engaged with the locking member 151. When the locking member 151 is engaged with the locking portion 135*a*, the locking member 151 locks the movement of the entirety consisting of the first piston 132 and the firing pin 14 relative to the first cylinder 131. When the locking member 151 is disengaged from the locking portion 135*a*, the locking member 151 releases the movement of the entirety consisting of the first piston 132 and the firing pin 14 relative to the first cylinder 131. It can be understood that when the firing pin 14 passes through the first piston 132, the locking portion 135*a* may further be formed at one end of the firing pin 14 facing away from the impact portion 141. The locking portion 135*a* and the impact portion 141 are respectively disposed on both sides of the first piston 132 along the direction of the first straight line 101, and the locking portion 135*a* may be formed by the first piston 132 or by one end of the firing pin 14 facing away from the impact portion 141.

When the prime mover 12 drives the second piston 134 to move from the first position to the second position in the second chamber 133*a*, the prime mover 12 is operative to drive the locking member 151 out of engagement with the locking portion 135*a*. At this moment, the locking member releases the movement of the combination of the first piston 132 and the firing pin 14 in the first chamber 131*a*. Thus, the first piston 132 may move within the first chamber 131*a* so that the firing pin 14 may output an impact force.

When the prime mover 12 drives the second piston 134 to the first position in the second cylinder 133, the locking member 151 is being engaged with the locking portion 135*a*, so that the movement of the first piston 132 may be locked in the first chamber 131*a*, in which case the firing pin 14 does not output an impact force to the fastener. Locking and releasing the firing pin 14 are finally achieved through locking or releasing the first piston 132. Compared to the way of directly locking or releasing the firing pin 14, the nail gun is given a better working stability, less vibration, and better reliability. Further, both the impact mechanism 13 and the locking mechanism 15 are powered up by the prime mover 12, in which case the number of power sources is reduced, so is the volume of the whole machine as well as the cost.

Alternatively, in some embodiments, the housing 11 may include a handle portion 111, a first receiving portion 112, and a second receiving portion 113. The first receiving portion 112 is configured for accommodating the impact mechanism 13 and the second receiving portion 113 is configured for accommodating the prime mover 12. The handle portion 111 and the second receiving portion 113 are respectively disposed at two ends of the first receiving portion 112 along a first straight line 101. The handle portion 111 and the second receiving portion 113 extend at both ends of the first housing portion 112 in an orientation perpendicular to the first straight line 101.

The prime mover 12 is an electric motor disposed in the housing 11 and includes an electric motor shaft 121 that is rotatable about a first axis 102 perpendicular to the first straight line 101. The electric motor shaft 121 is a shaft about which the prime mover 12 rotates. Alternatively, in some embodiments, the nail gun 100 may further include a battery pack configured for powering the motor, and the battery pack is detachably connected to the handle portion 111.

In this embodiment, the first cylinder 131 and the second cylinder 133 are arranged side by side, and the first chamber 131*a* and the second chamber 133*a* are separated from each other and are in communication with each other via a passage.

The first piston 132 is operative to perform a reciprocating motion in the first chamber 131*a* along a second straight line 103 parallel to the first straight line 101.

Further provided in the housing 11 is a transmission mechanism 17 capable of driving at least the second piston 134 into motion within the second chamber 133*a*. The transmission mechanism 17 may include a first connecting rod 171, a second connecting rod 172, and a first rotating shaft 173. The first connecting rod 171 and the electric motor shaft 121 constitute a rotatable connection that may pivot about the first axis 102. One end of the second connecting rod 172 is rotatably connected to the first connecting rod 171 through the first rotating shaft 173, and the other end is rotatably connected to the second piston 134. An axis of the second connecting rod 172 relative to the first connecting rod 171 is parallel to the first axis 102 of the electric motor shaft 121. Thus, when the electric motor shaft 121 rotates, the second piston 134 is driven to perform a reciprocating motion by the first connecting rod 171 and the second connecting rod 172 along the first straight line 101 in the second chamber 133*a* between the first position and the second position.

The nail gun 100 further includes a biasing member 152 disposed in the housing 11 for pressing the locking member 151 toward a position at which the locking member 151 is engaged with the locking portion 135*a* and a drive mechanism 18 for driving the locking member 151 against the bias of the biasing member 152 to disengage from the locking portion 135*a*

In this embodiment, the first piston 132 is fixedly connected to the first connecting member 135, and the first connecting member 135 is formed with the above-mentioned locking portion 135*a* for engaging with the locking member 151.

Alternatively, in some embodiments, the first connecting member 135 is a rod that is connected to the first piston 132 and that extends in the direction of the second straight line 103. The locking portion 135*a* is a groove defined in the rod.

The groove penetrates the rod in a direction perpendicular to the first straight line 101 and the third straight line 104 of the first axis 102, and is also open toward a direction parallel to the first axis 102. The locking member 151 is a locking pin that is disposed in the housing 11 and that extends in the direction of the third straight line 104. The biasing member 152 is a spiral spring that moves in a direction parallel to the first axis 102 to press the locking pin to fit into the groove. The drive mechanism 18 includes a driving member 181 driven by the prime mover 12, and drives the locking member 151 to move in a direction parallel to the first axis 102 and overcome the bias force of the biasing member 152 to disengage from the locking portion 135*a*.

Alternatively, in some embodiments, the driving member 181 is formed with a driving portion 181*a* configured for driving the movement of the locking member 151, the driving portion 181*a* may be a first slope that may contact the locking pin, and the plane at which the first slope is located intersects obliquely with the first straight line 101.

In order to realize that the prime mover 12 simultaneously drives the impact mechanism 13 and the locking mechanism 15 when starting, the transmission mechanism 17 further includes: a third connecting rod 174 and a toggle member 175. One end of the third connecting rod 174 and the first connecting rod 171 are also rotatably connected by the first rotating shaft member 173, and the other end is configured to be rotatably connected with the toggle member 175. Further, the rotational axis of the rotatable connection of the third connecting rod 174 and the first connecting rod 171 is parallel to the first axis 102, and so is the rotational axis of the rotatable connection of the toggle member 175 and the third connecting rod 174. The toggle member 175 may be a cam, including a convex portion 175*a* that is in contact with the driving member 181. The convex portion 175*a*, enabling the driving member 181 to move toward a position where the driving portion 181*a* contacts the locking member 151, is a toggle portion of the toggle member 175. Thus, when the prime mover 12 is activated, the cam may make the driving member 181 move in a direction parallel to the first straight line 101 while rotating.

Alternatively, in some embodiments, the driving member 181 includes: a pair of mutually parallel arms 181*b* extending in the direction parallel to the first straight line 101, an end plate 181*c* configured for engaging with the cam and disposed at one end of the arm 181*b*, and an extension portion 181*d* configured for forming a first slope, disposed at the other end of the arm 181*b*, and presented roughly as an inverted L-shaped structure. In addition, in order to reset the driving member 181, the nail gun 100 further includes an elastic member 182 disposed within the housing 11 for pressing the end plate 181*c* such that the first slope moves in a direction away from the locking pin.

In addition, the first connecting member 135 is further formed with a second slope 135*b* capable of driving the locking pin to move in a direction parallel to the first axis 102. Thus, when the first piston 132 is reset, the second slope 135*b* may firstly drive the locking pin to move downward against the bias force of the biasing member 152. Then when the first piston 132 is reset to a state where the groove is aligned with the locking pin, the biasing member 152 re-presses the locking pin up to the groove.

The following is an example of the working process of the technical solution of the present disclosure: as illustrated in FIGS. 2-6, after the prime mover 12 is started, the electric motor shaft 121 starts to rotate. When the second connecting rod 172 is operative to drive the second piston 134 to the first position, at this moment, the third connecting rod 174 drives the toggle member 175 to rotate such that the convex portion 175*a* of the cam is not in contact with the end plate 181*c*. At this moment, the elastic member 182 presses the end plate 181*c* such that the driving member 181 moves in a direction parallel to the first straight line 101 and toward a direction in which the driving portion 181*a* moves away from the locking member 151. At this moment, the biasing member 152 presses the locking member 151 such that the locking member 151 is moved toward the position where it is engaged with the locking portion 135*a* to lock the first piston 132. Thus, the position of the first piston 132 in the first chamber 131*a* is locked, and the firing pin 14 fixedly connected to the first piston 132 is locked so that the impact force cannot be output.

Figure 7:
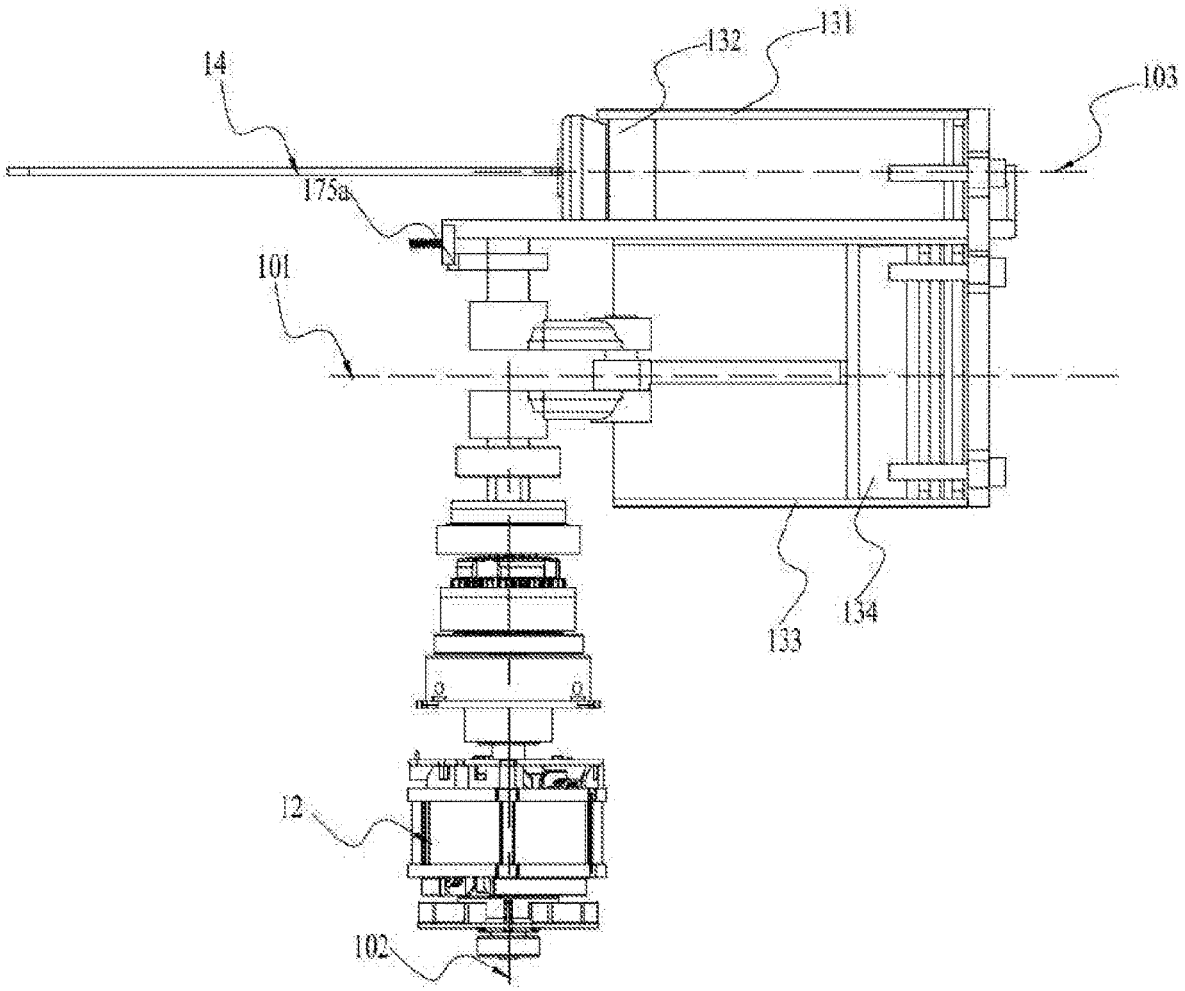
FIG. 7 is a plan view illustrating the structure of FIG. 2 when the second piston is located in the second position and the first and second cylinders are sectioned, in accordance with the present disclosure.
Figure 8:
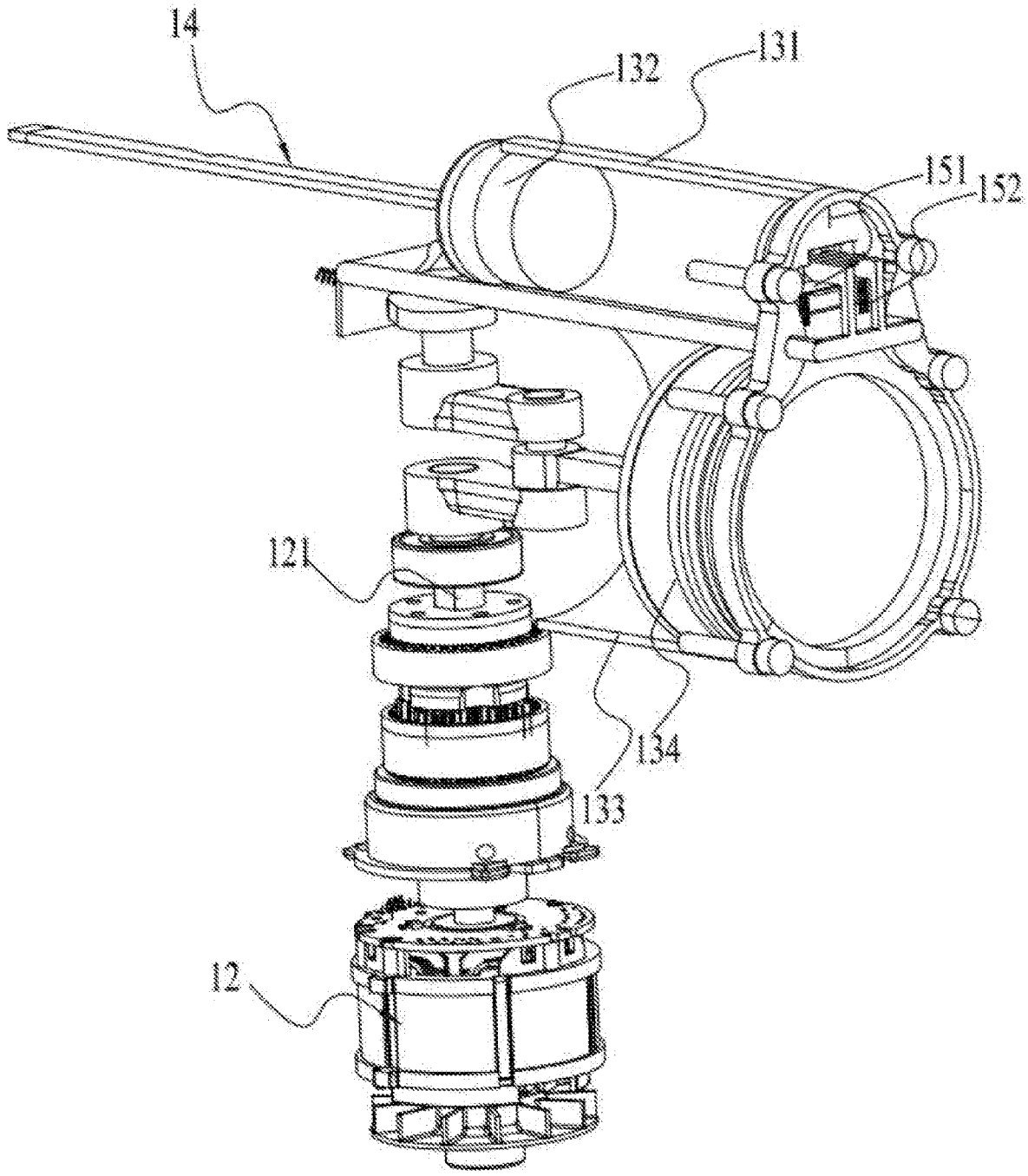
FIG. 8 is a perspective view illustrating a prime mover, an impact mechanism, a firing pin, and a locking mechanism of FIG. 7 in accordance with the present disclosure.
Figure 9:
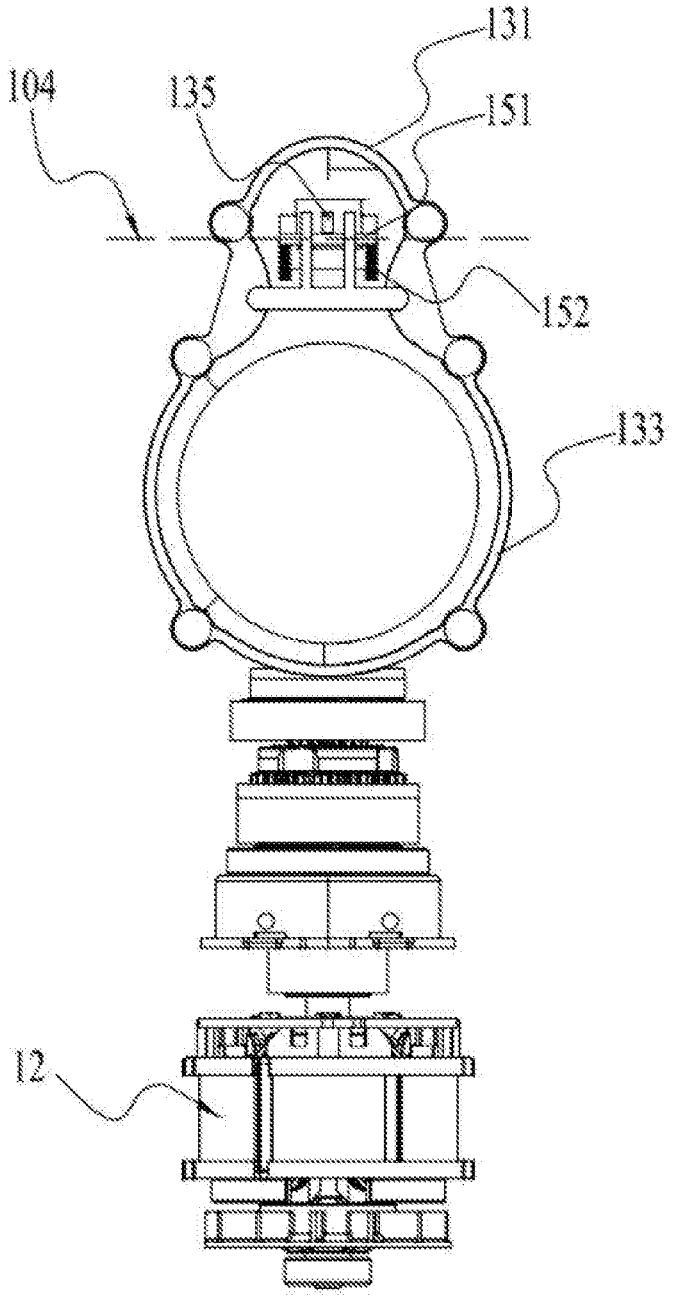
FIG. 9 is a perspective view illustrating the prime mover, the impact mechanism, the firing pin, and the locking mechanism of FIG. 7 in accordance with the present disclosure.
Figure 10:
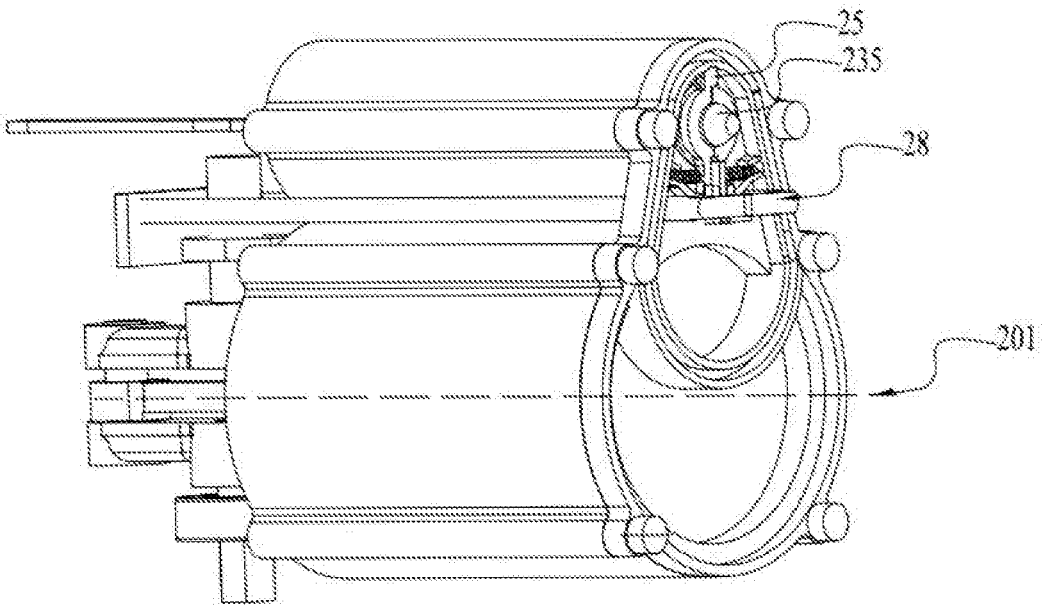
FIG. 10 is a partial perspective view illustrating a nail gun of a second embodiment in accordance with the present disclosure.
Figure 11:
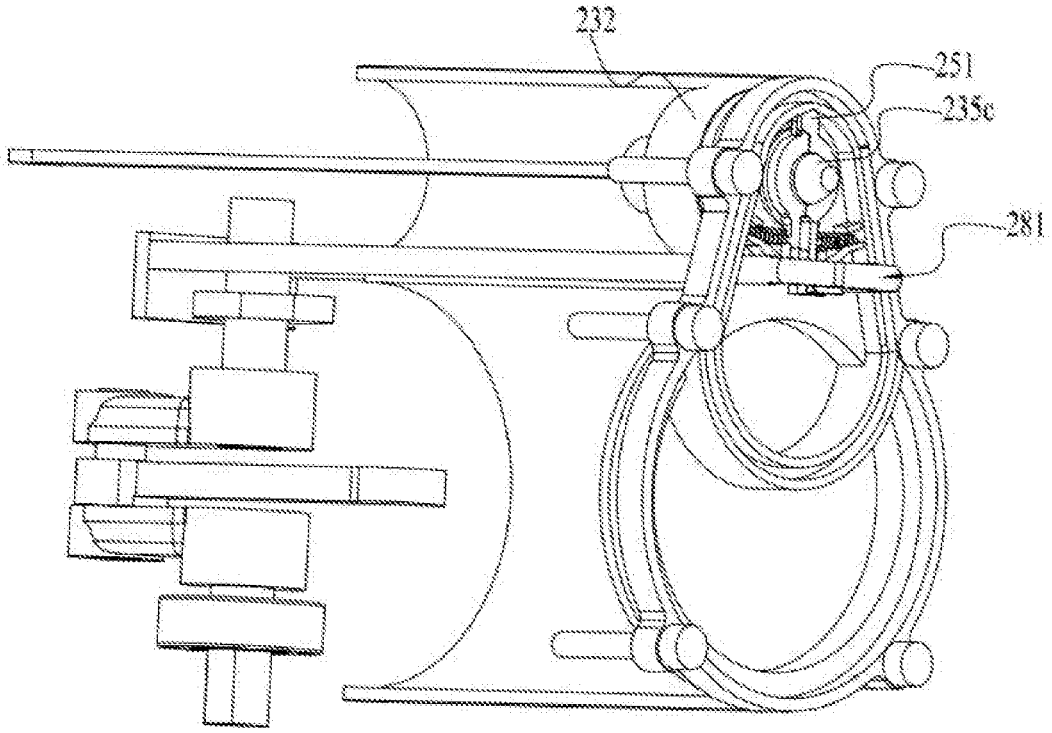
FIG. 11 is a perspective view illustrating the structure of FIG. 10 after a partial structure has been sectioned in accordance with the present disclosure.
Figure 12:
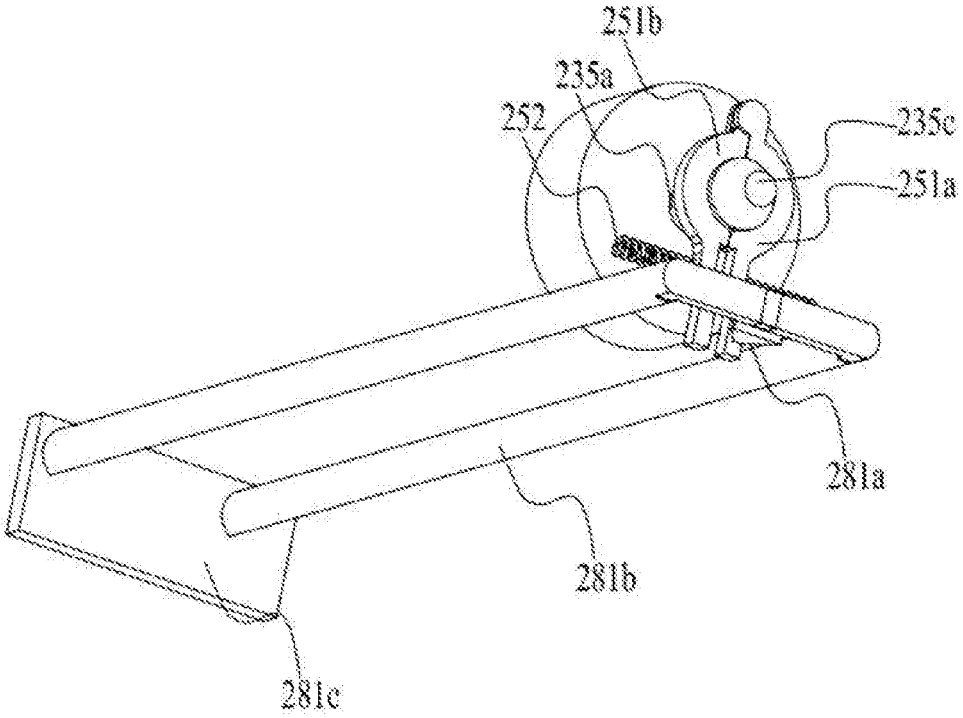
FIG. 12 is a schematic diagram illustrating the drive assembly, the locking assembly, and the first piston of FIG. 10 where the locking member is operative to lock the first piston in accordance with the present disclosure.
Figure 13:
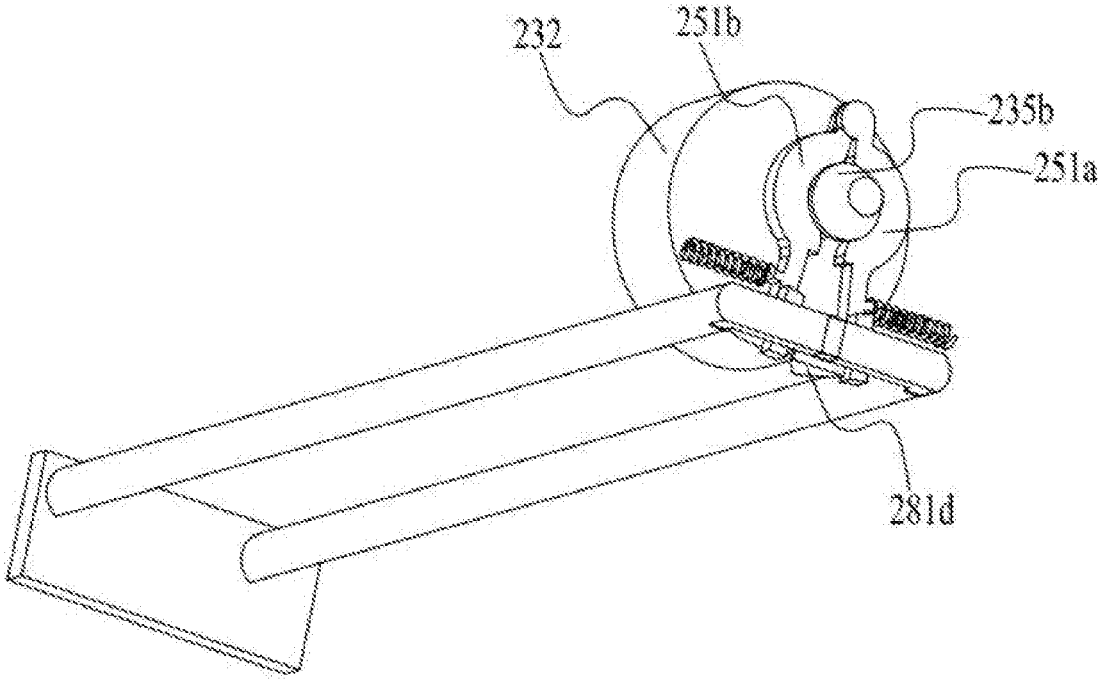
FIG. 13 is a schematic diagram illustrating the drive assembly, the locking assembly, and the first piston of FIG. 10 where the locking member is operative to release the first piston in accordance with the present disclosure.
Figure 14:
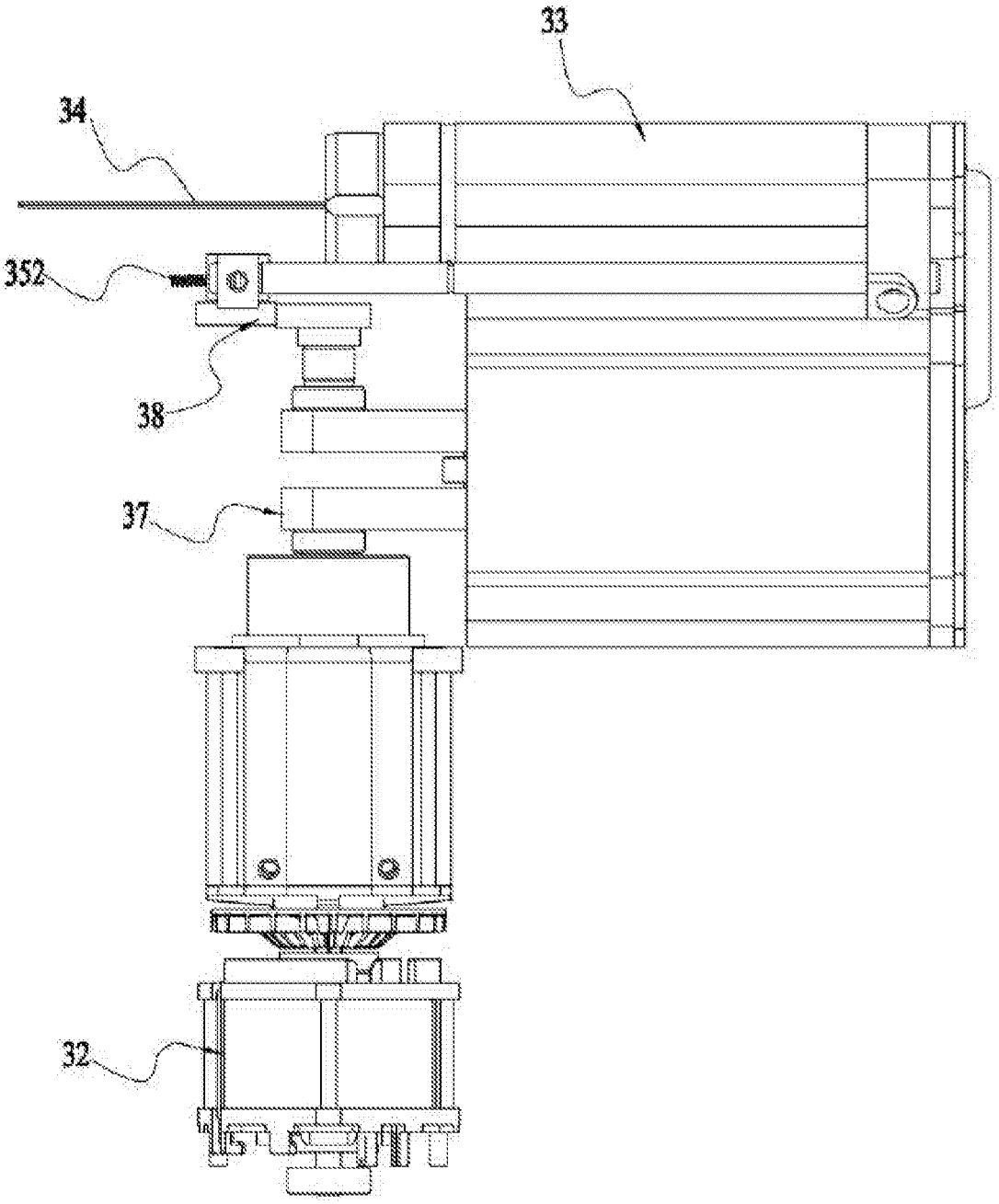
FIG. 14 is a partial plan view illustrating a nail gun of a third embodiment in accordance with the present disclosure.
Figure 15:
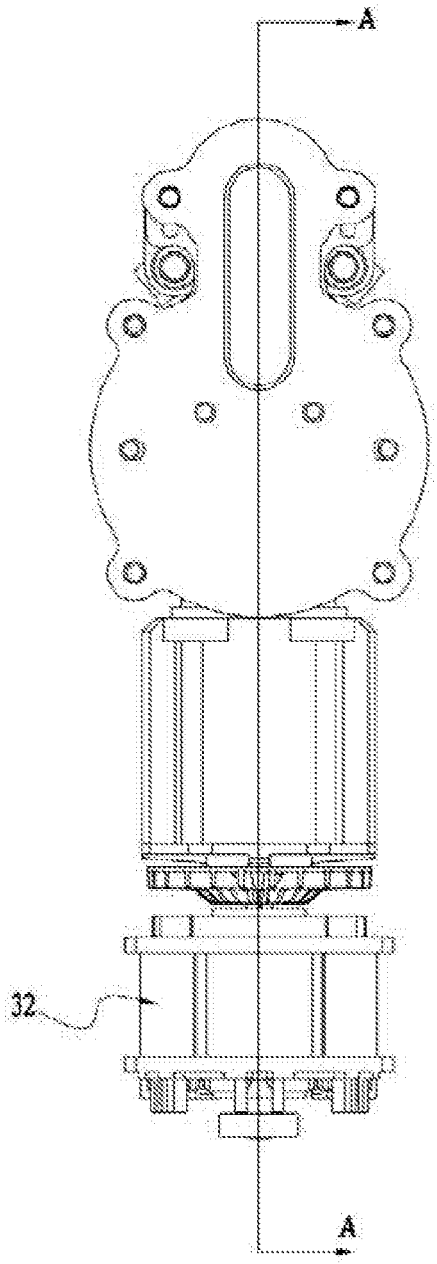
FIG. 15 is a right side view illustrating the structure of FIG. 14 in accordance with the present disclosure.
Figure 16:
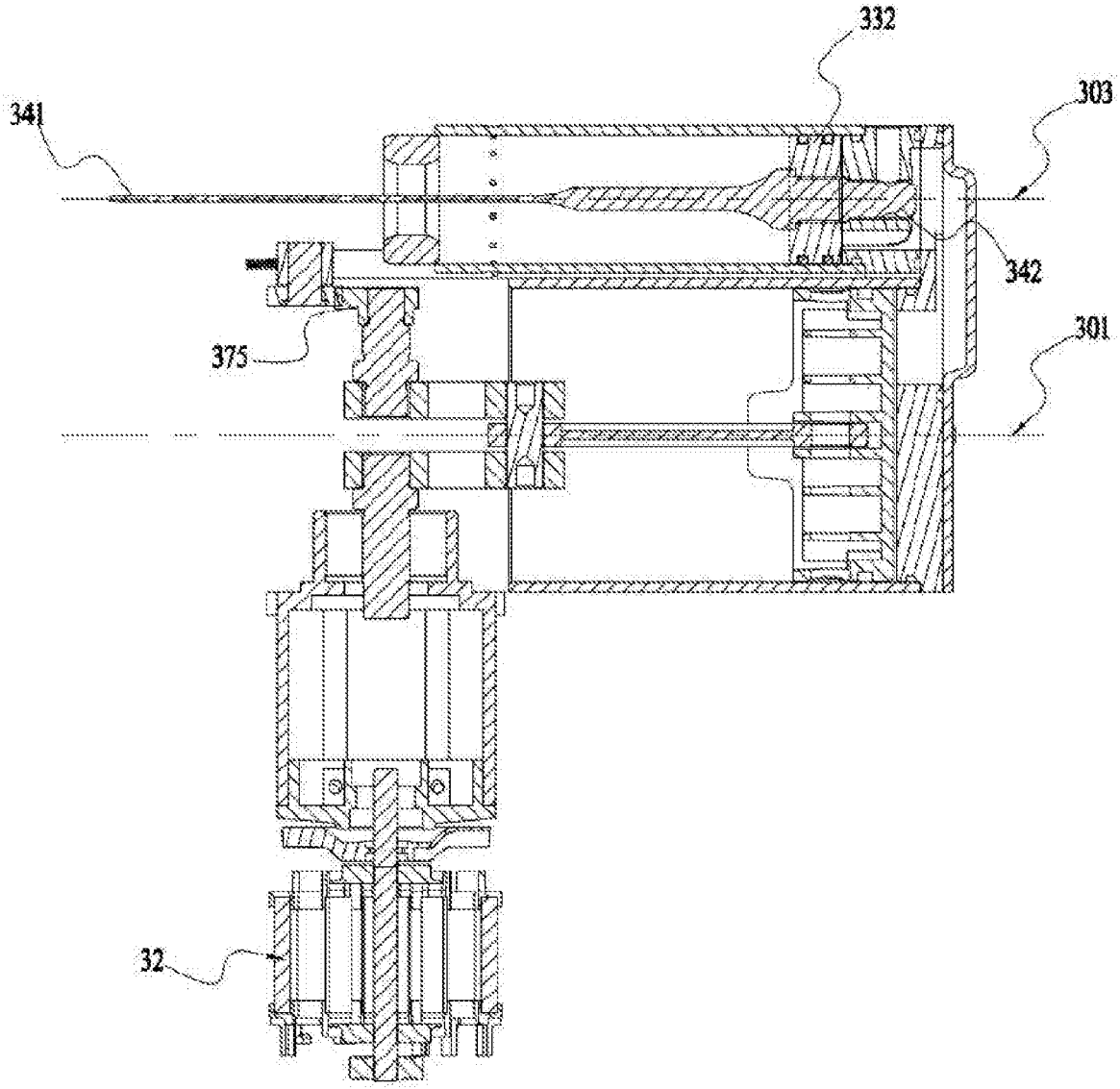
FIG. 16 is a cross-sectional diagram illustrating the structure of FIG. 14 taken along a line A-A in accordance with the present disclosure.
Figure 17:
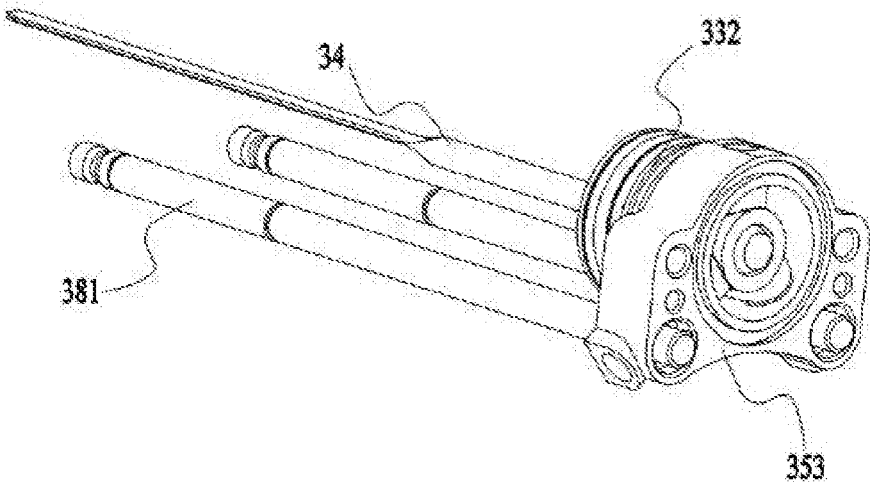
FIG. 17 is a perspective view illustrating the firing pin, the first piston, the driving member, and the locking structure of FIG. 14 in accordance with the present disclosure.
Figure 18:
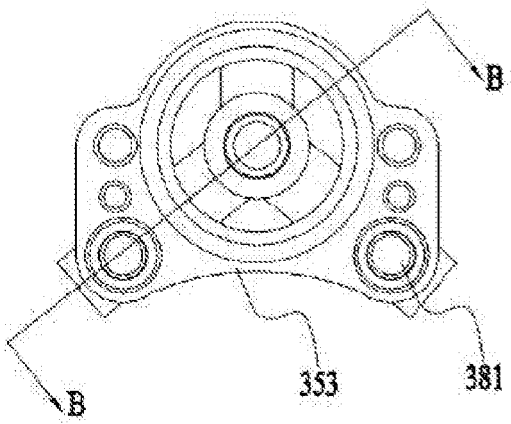
FIG. 18 is a right side view illustrating the structure of FIG. 17 in accordance with the present disclosure.
Figure 19:
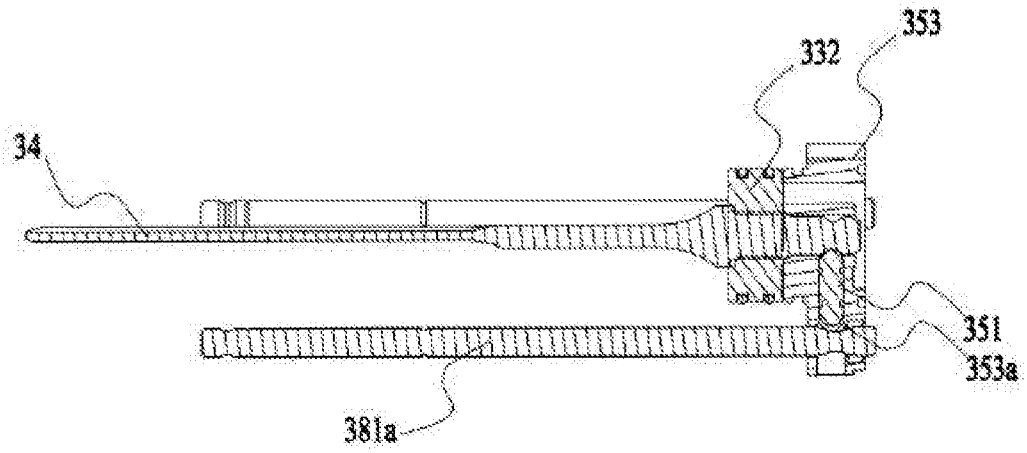
FIG. 19 is a cross-sectional view illustrating the structure of FIG. 18 taken along a line B-B in accordance with the present disclosure.
Figure 20:
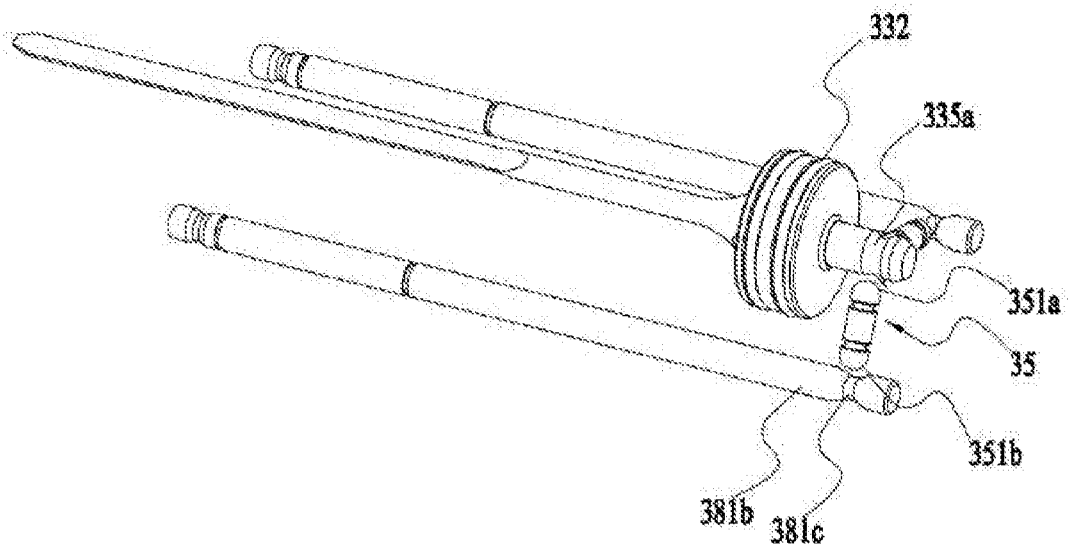
FIG. 20 is a perspective view illustrating the firing pin, the driving member, the first piston, and the locking structure of FIG. 17 in accordance with the present disclosure.

As illustrated in FIGS. 7-9, when the electric motor shaft 121 continues to rotate to make the second connecting rod 172 drive the second piston 134 to the second position, at this moment, the third connecting rod 174 drives the toggle member 175 to rotate to make the convex portion 175*a* of the cam contact the end plate 181*c*. At this moment, the driving member 181 moves in a direction parallel to the first straight line 101, such that the driving portion 181*a* drives the locking member 151 against the bias of the biasing member 152 to disengage the locking member 151 from the locking portion 135*a*, thereby the movement of the first piston 132 in the first chamber 131*a* is released. At this moment, under the action of the compressed gas, the first piston 132 drives the firing pin 14 to output an impact force in the first chamber 131*a*.

The present disclosure further proposes a nail gun of the second embodiment. As illustrated in FIGS. 10-13, the nail gun may have the same housing, prime mover, impact mechanism, firing pin, transmission mechanism and nail box as the nail gun 100 of the first embodiment. However, the nail gun in this embodiment may be different from the nail gun 100 in the first embodiment, the difference may exist in the locking mechanism 25 and the drive mechanism 28. Only the differences between the present embodiment and the first embodiment will be described below. For the detailed description of the rest same parts, reference may be made to the related description in the first embodiment.

As illustrated in FIGS. 10-13, the first piston 232 is fixedly connected to a first connecting member 235, the locking member 251 is disposed in the housing and includes a pair of a first clamping portions 251*a* and a second clamping portions 251*b* capable of clamping the first connecting member 235 between them to lock the first piston 232, and the first clamping portion 251*a* and the second clamping portion 251*b* are rotatably connected at one end and the other end may be engaged with the drive mechanism 28. The biasing member 252 presses the first clamping portion 251*a* and the second clamping portion 251*b* such that they both rotate relative to each other to a position where the first connector 235 is clamped.

Alternatively, in some embodiments, the first link 235 includes a cylindrical rod portion 235*a* that may be clamped by the first clamping portion 251*a* and the second clamping portion 251*b*, and a stopper portion 235*c* formed at one end of the rod portion 235*a* to prevent the rod portion 235*a* from disengaging from the first clamping portion 251*a* and the second clamping portion 251*b*. Further, the rod portion 235*a* is a locking portion formed by the first connecting member 235 for engaging with the locking member 251. The biasing member 252 is a pair of spiral springs respectively provided on both sides of the first clamping portion 251*a* and the second clamping portion 251*b* and press the first clamping portion 251*a* and the second clamping portion 251*b*. The drive mechanism 28 includes a driving member 281 driven by the prime mover, and the driving member 281 is operative to drive the first clamping portion 251*a* and the second clamping portion 251*b* to rotate toward a position where the first connecting member 235 is released.

Alternatively, in some embodiments, the driving member 281 is formed with a driving portion 281*a* configured for driving the movement of the locking member 251, the driving portion 281*a* may be a first slope that may contact the first clamping portion 251*a* and the second clamping portion 251*b*, and the plane at which the first slope is obliquely intersected with the direction of the first line 201.

Alternatively, in some embodiments, the driving member 281 includes: a pair of mutually parallel arms 281*b* extending in the direction parallel to the first straight line 201, an end plate 281*c* configured for engaging with the cam and disposed at one end of the arm 281*b*, and an extension portion 281*d* configured for forming a first slope and disposed at the other end of the arm 281*b*, the extending portion 281*d* extends in a direction parallel to the first straight line 201 and toward the electric motor.

In addition, the first connecting member 235 is further formed with a second slope 235*b* capable of driving the relative rotation of the first clamping portion 251*a* and the second clamping portion 251*b*. Thus, when the first piston 232 is reset, the second slope 235*b* may firstly drive the first clamping portion 251*a* and the second clamping portion 251*b* against the bias force of the biasing member 252 to move away from each other. Then when the first piston 232 is reset to a state where the first clamping portion 251*a* and the second clamping portion 251*b* are aligned with the rod portion 235*a*, the biasing member 252 re-presses the first clamping portion 251*a* and the second clamping portion 251*b* to move toward the position where the rod portion 235*a* is clamped.

The present disclosure further proposes a nail gun of the third embodiment. As illustrated in FIGS. 14-20, the nail gun in the present embodiment may have the same housing, prime mover 32, impact mechanism 33, transmission mechanism 37, and nail box as the nail gun 100 of the first embodiment. However, the nail gun in this embodiment may be different from the nail gun 100 in the first embodiment, the difference may exist in the locking mechanism 35 and the drive mechanism 38. Only the differences between the present embodiment and the first embodiment will be described below. For the detailed description of the rest same parts, reference may be made to the related description in the first embodiments.

In this embodiment, the firing pin 34 passes through the first piston 332 in the direction of the first straight line 301, a portion of the firing pin 34 that passes through the first piston 332 and away from the impact portion 341 is a protruding portion 342, and the protruding portion 342 and the impact portion 341 are respectively located on both sides of the first piston 332 in the direction of the first straight line 301 It can be understood that the protruding portion 342 may also be a separate component that is fixedly connected to the first piston 332, or the protruding portion 342 may also be directly formed by the extending of the first piston 332.

A locking portion 335*a* is formed on the protruding portion 342, the locking portion 335*a* is a groove formed on the protruding portion 342, and the groove may be an annular groove centered around the second straight line 303 parallel to the first straight line 301. The drive mechanism 38 includes a motion for driving the locking member 351 into the groove to lock the entirety consisting of the first piston 332 and the firing pin 34. The locking member 351 is a locking pin that is movable in a radial direction perpendicular to the second straight line 303. The locking pin extending in a radial direction perpendicular to the second straight line 303, and the radial direction perpendicular to the second straight line 303 is also perpendicular to the first line 301. The movement of the entirety consisting of the first piston 332 and the firing pin 34 may be locked when the locking pin is inserted into the annular groove. The locking pin includes a first spherical surface 351*a* and a second spherical surface 351*b* at both ends in a radial direction perpendicular to the second straight line 303, respectively, the first spherical surface 351*a* is configured for engaging with the annular groove, and the second spherical surface 351*b* is configured for engaging with the driving member 381. It is understood that in other embodiments the locking pin may also be replaced with a steel ball. The driving member 381 includes an arm 381*a* extending in a direction parallel to the first straight line 301, the toggle member 375 in the transmission mechanism 37 is capable of driving the driving member 381 such that the arm 381*a* moves in a direction parallel to the first straight line 301. A first locking surface 381*b* and a first release surface 381*c* are formed on the arm 381*a*. The first locking surface 381*b* is operative to drive the locking pin into the groove when contacting the second spherical surface 351*b* of the locking pin, and the first release surface 381*c* is operative to allow the locking pin to disengage from the groove when contacting the second spherical surface 351*b* of the locking pin.

In a direction perpendicular to the second straight line 303, the first release surface 381*c* is recessed in a direction away from the locking pin relative to the first locking surface 381*b*. The locking mechanism 35 further includes a biasing member 352 for pressing the driving member 381, and the biasing component 352 is operative to produce a bias force that moves the driving member 381 toward a position where the first locking surface 381*b* contacts the locking member 351.

In the embodiment, the locking mechanism 35 further includes a receiving member 353 for receiving the locking member 351. The receiving member 353 forms a receiving groove 353*a* extending in a radial direction perpendicular to the second straight line 303, and the locking member 351 may be slidably disposed in the receiving groove 353*a*.

INDUSTRIAL APPLICABILITY

The present disclosure provides a nail gun that may lock the firing pin by locking the first piston, so that the firing pin is with high locking reliability.

The above illustrates and describes basic principles, main features and advantages of the present disclosure. Those skilled in the art should appreciate that the above embodiments do not limit the present disclosure in any form. Technical solutions obtained by equivalent substitution or equivalent variations all fall within the scope of the present disclosure. What is desired to be protected is set forth in the following claims.

What is claimed is:

1. A nail gun, comprising:

a housing;

a firing pin, comprising an impact portion configured for impacting a fastener;

a prime mover, disposed within the housing;

a first air cylinder, defining a first chamber;

a first piston, disposed in the first chamber and fixedly connected to the firing pin;

a second air cylinder, defining a second chamber that is in communication with the first chamber;

a second piston, disposed in the second chamber and operative to be driven by the prime mover to perform a reciprocating motion between a first position and a second position along a first straight line; and a locking member, configured for locking or releasing an entirety comprised of the first piston and the firing pin relative to the first air cylinder;

wherein the entirety comprised of the first piston and the firing pin is integrally formed or connected with: a locking portion configured for engaging with the locking member; and wherein when the second piston is at the first position, the locking member is operative to be engaged with the locking portion to lock the first piston within the first chamber; when the second piston is at the second position, the prime mover is operative to drive the locking member out of engagement with the locking portion to release the first piston within the first chamber;

wherein the impact portion is disposed on a front side of the first piston, and the locking portion is disposed on a rear side of the first piston.

2. The nail gun according to claim 1, wherein the locking member is disposed on the rear side of the first piston facing away from the impact portion.

3. The nail gun according to claim 1, wherein the prime mover is an electric motor.

4. The nail gun according to claim 1, further comprising:

a biasing component, operative to produce a bias force that moves the locking member toward a position at which the first piston is locked.

5. The nail gun according to claim 4, further comprising:

a driving member, operative to be driven by the prime mover to perform a reciprocating motion along an orientation parallel to the first straight line;

wherein the driving member is formed or connected with a driving portion;

wherein when the second piston is at the second position, the driving member is operative to move in a direction parallel to the first straight line, and the driving portion is operative to drive the locking member out of engagement with the locking portion.

6. The nail gun according to claim 5, wherein the first piston is fixedly connected to a first connecting member formed with the locking portion;

wherein the locking portion is a groove defined in the first connecting member; the locking member is a locking pin operative to be at least partially embedded in the groove, and the biasing component is operative to press the locking pin to move toward being embedded into the groove; and wherein the driving portion is a slope that is operative to drive the locking pin to move in a direction away from the groove.

7. The nail gun according to claim 5, wherein the first piston is fixedly connected to a first connecting member that is formed with the locking portion;

wherein the locking member comprises a first clamping portion and a second clamping portion that are rotatably connected at one end; the biasing component is operative to press the first clamping portion and/or the second clamping portion, so that they both rotate toward each other to clamp the first connecting member; and wherein the driving portion is a slope that is operative to drive the first clamping portion, and/or the second clamping portion, so that they both rotate away from each other to release the first connecting member.

8. The nail gun according to claim 6, wherein the first connecting member and the firing pin are respectively disposed on both sides of the first piston.

9. The nail gun according to claim 6, wherein the prime mover further comprises a shaft operative to rotate around a first axis;

the nail gun further comprises:

a first connecting rod, rotatably connected to the shaft;

a second connecting rod, one end of which is rotatably connected to the first connecting rod, and another end of which is rotatably connected to the second piston; and a first shaft, configured to be a rotating shaft by which the first connecting rod and the second connecting rod are rotatably connected.

10. The nail gun according to claim 9, further comprising:

a third connecting rod, rotatably connected to the first connecting rod through the first shaft;

a toggle member, rotatably connected to the third connecting rod;

wherein the toggle member comprises a toggle portion that when rotating is operative to drive the driving member to move toward a position where the driving portion contacts the locking member.

11. The nail gun according to claim 1, wherein the entirety comprised of the fire pin and the first piston further comprises: a protruding portion which is configured for forming the locking portion, and which is located at a side of the first piston away from the impact portion;

the locking portion is a groove defined in the protruding portion; and the nail gun further comprises: a driving member, configured for driving the locking member to be embedded into the groove to lock the entirety comprised of the first piston and the fire pin relative to the first air cylinder.

12. The nail gun according to claim 11, wherein the driving member is formed with:

a first locking surface, configured to drive the locking member to be embedded in the groove in response to contacting the locking member; and a first release surface, configured to allow the locking member to be disengaged from the groove in response to contacting the locking member.

13. The nail gun according to claim 12, wherein the groove is an annular groove with a centerline parallel to the first straight line;

the locking member is a locking pin that extends in a direction perpendicular to the first straight line; and two ends of the locking pin are respectively formed with: a first spherical surface configured for engaging with the groove and a second spherical surface configured for engaging with the driving member; wherein in an orientation perpendicular to the first straight line, the first release surface is recessed in a direction away from the locking pin relative to the first locking surface.

14. The nail gun according to claim 12, wherein the groove is an annular groove with a centerline parallel to the first straight line; the locking member is a steel ball operative to move in an orientation perpendicular to the first straight line to be embedded into the groove;

wherein in the orientation perpendicular to the first straight line, the first release surface is recessed in a direction away from the locking pin relative to the first locking surface.

15. The nail gun according to claim 13, further comprising:

a biasing member, operative to produce a bias force that moves the driving member toward a position where the first locking surface contacts the locking member.

16. The nail gun according to claim 15, wherein the prime mover further comprises: a shaft operative to rotate about a first axis;

the nail gun further comprises:

a first connecting rod, rotatably connected to the shaft;

a second connecting rod, one end of which is rotatably connected to the first connecting rod, and another end of which is rotatably connected to the second piston; and a first shaft, configured to be rotating shaft by which the first connecting rod and the second connecting rod are rotatably connected.

17. The nail gun according to claim 16, further comprising:

a third connecting rod, rotatably connected to the first connecting rod through the first shaft member; and a toggle member, rotatably connected to the third connecting rod;

wherein the toggle member comprises a toggle portion that when rotating is operative to drive the driving member to move toward a position where the first release surface contacts the locking member.

18. The nail gun according to claim 17, wherein the fire pin passes through the first piston along the first straight line; a portion of the fire pin on a side of the first piston away from the impact portion constitutes the protruding portion.

* * * * *